US006347956B2

(12) United States Patent
Bogdan et al.

(10) Patent No.: US 6,347,956 B2
(45) Date of Patent: Feb. 19, 2002

(54) ELECTRICAL CABLE CONNECTOR

(75) Inventors: Gabriel Bogdan, Gummerbach; Britta Straesser, Sieburg; Dietmar Harting, Espelkamp; Achim Brenner, Luebbecke; Dirk Oberhokamp, Bielefeld; Stephan Schreier, Rahden, all of (DE)

(73) Assignees: Albert Ackermann GmbH & Co. KG, Gummersbach; Harting KgaA, Espelkiamp, both of (DE)

( * ) Notice: Subject to any disclaimer, the term of this patent is extended or adjusted under 35 U.S.C. 154(b) by 0 days.

(21) Appl. No.: 09/271,442

(22) Filed: Mar. 18, 1999

(30) Foreign Application Priority Data

Mar. 18, 1998 (DE) ..... 198 11 667

(51) Int. Cl.[7] ..... H01R 4/24; H01R 4/26; H01R 11/20

(52) U.S. Cl. ..... 439/411

(58) Field of Search ..... 439/610, 284, 439/417, 404, 411, 412

(56) References Cited

U.S. PATENT DOCUMENTS 4,884,981 A 12/1989 Chandler et al.
5,290,175 A * 3/1994 Robinson et al. ..... 439/540
5,423,694 A * 6/1995 Jensen et al. ..... 439/417
5,998,737 A * 12/1999 Weiss et al. ..... 174/135
6,025,982 A * 2/2000 Brower ..... 361/119

FOREIGN PATENT DOCUMENTS

EP 0555810 A2 8/1993
EP 0735612 A1 10/1996

OTHER PUBLICATIONS

German Patent Office Action, Nov. 20, 1998.

* cited by examiner

*Primary Examiner*—Brian Sircus
*Assistant Examiner*—Chaudika Prasad
(74) *Attorney, Agent, or Firm*—Crowell & Moring LLP

(57) ABSTRACT

A connector is provided for connecting a cable by insulation-piercing connecting devices when insert elements are pushed together. For connecting a shielded cable, the insert element are provided on a contact element made of conducting material, and the latter are inserted with contact into a shielded housing. The braided shield of the cable is connected with the housing. The insulation-piercing connecting devices are located in insulating bodies that are accommodated in chambers of the housing that are open to the outside. The housing is connected with the contact element by a screw that extends in the plugging direction and operates to make contact.

6 Claims, 2 Drawing Sheets

ELECTRICAL CABLE CONNECTOR

This application claims the priority of German application 198 11 667.5, filed Mar. 18, 1998, the disclosure of which is expressly incorporated by reference herein.

BACKGROUND AND SUMMARY OF THE INVENTION

The invention relates to a connector in which the end sections of the wires of a cable to be connected are held in the guides of clips made of insulating material at an angle to the plugging direction and are contacted by insulation-piercing connecting devices located in the individual chambers of a carrier body which is displaceable relative to the clips in the plugging direction.

A connector of this type is known from European Patent Document No. EP 0 554 810 A2. Connectors of this kind have the advantage that the insulation-piercing connecting device of the contact elements is extremely simple in design and a connection is produced by squeezing two parts of an insulating body together. Connectors of this known type however are not automatically suitable for making 2-, 4-, or 8 -pole connectors for analog and digital data transmission which can be used in a shielded design even at frequencies up to 600 MHz and over 600 MHz.

It is also known to provide shielded connectors according to IEC Design Specification 603-7. However it has been found that these connectors are not sufficient for frequencies above 200 MHz since the insertion damping, return loss, and near cross talk damping do not maintain the required values.

Therefore a goal of the present invention is to design a connector of the species recited at the outset, in which the connection can be made as a shielded connection in a very simple fashion without having to strip the cable ends of their insulation.

To achieve this goal, in a connector of the species recited at the outset, provision is made for connecting a shielded cable such that the clips are mounted on a contact element comprised of electrically conducting material with the element being insertable into a housing that is shielded and serves as a supporting body and contacting its walls, such that the shielding of the cable can be attached to the contact element, such that the insulation-piercing connecting devices are located in insulating bodies accommodated in the shielded chambers of the housing that are formed by separating ribs inside the housing, and such that the housing is connected with the contact element in a contacting fashion by a screw that extends in the plugging direction.

With this design it is possible in relatively simple fashion, after stripping the braided shield of the cable to be connected, to introduce the free wire ends into their corresponding clips where they are held at an angle to the plugging direction, and then to associate these clips with the conducting contact element or to use the screw to pull the clip into the bushing housing after it has been connected with the cable shielding, with the contact to the shielded housing being made via the contact element and the screw and with the contact to the wires being made by the screwing process.

In an improvement on the invention, this group can be accessible from the open connecting side of the housing so that there is no difficulty in assembly.

In an improvement on the invention, the contact element can be designed as a cross with a central thread to which the shielding of the cable is attached in a manner known of itself by a crimping ring. Finally, a protective cap can be pushed over this crimping ring and the plug housing.

Other objects, advantages and novel features of the present invention will become apparent from the following detailed description of the invention when considered in conjunction with the accompanying drawings.

DETAILED DESCRIPTION OF THE DRAWINGS

Figure 1:
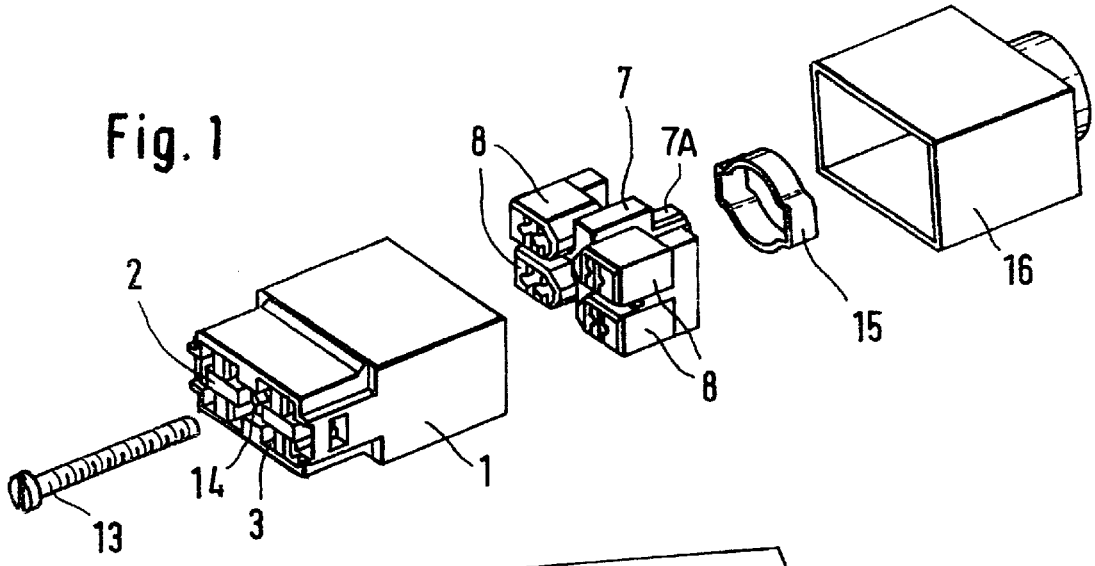
FIG. 1 is a perspective exploded view of a connector constructed according to a preferred embodiment of the invention.
Figure 2:
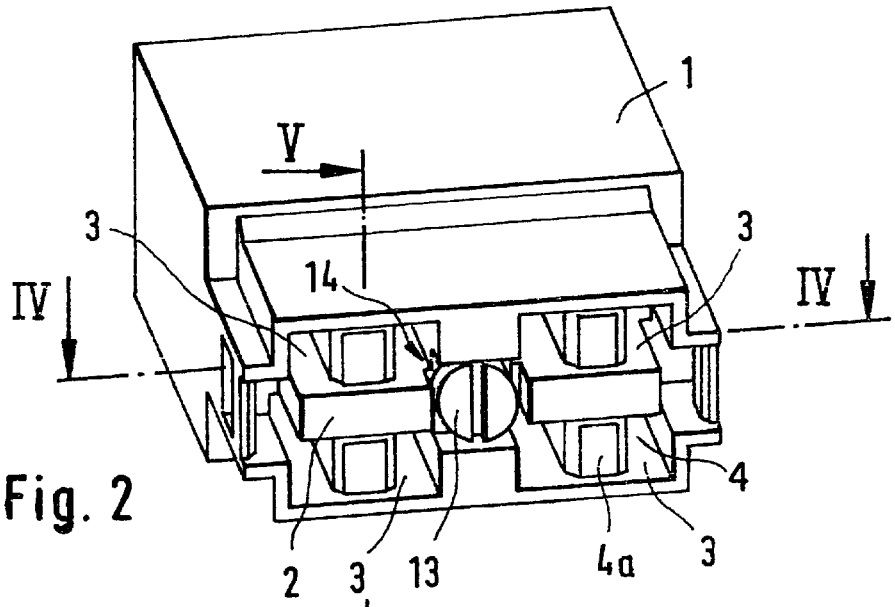
FIG. 2 is an enlarged view of the connector of FIG. 1 as seen from the plugging side.

It is evident from FIG. 1 that the connector according to the invention that serves for connecting a shielded cable (shielding S schematically depicted) consists of a shielded housing 1 with separating ribs or partitions 2 by means of which a plurality of separate chambers 3, each shielded over 360 degrees, are produced inside housing 1. Housing 1 can be made from an electrically conducting material, die-cast metal for example. Insulating bodies 4 can be inserted into this housing, as can be seen particularly well from FIGS. 4 to 6. These bodies 4 hold the contacts 5 and are each provided with projecting pins 4*a,* by which the contacts 5 can be contacted by corresponding plugs.

Figure 3:
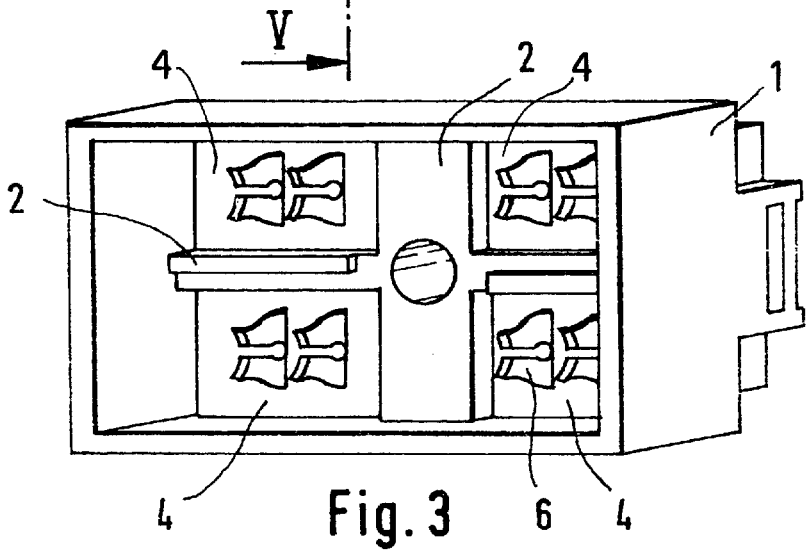
FIG. 3 shows the connector housing of FIG. 2 from the connecting side.
Figure 4:
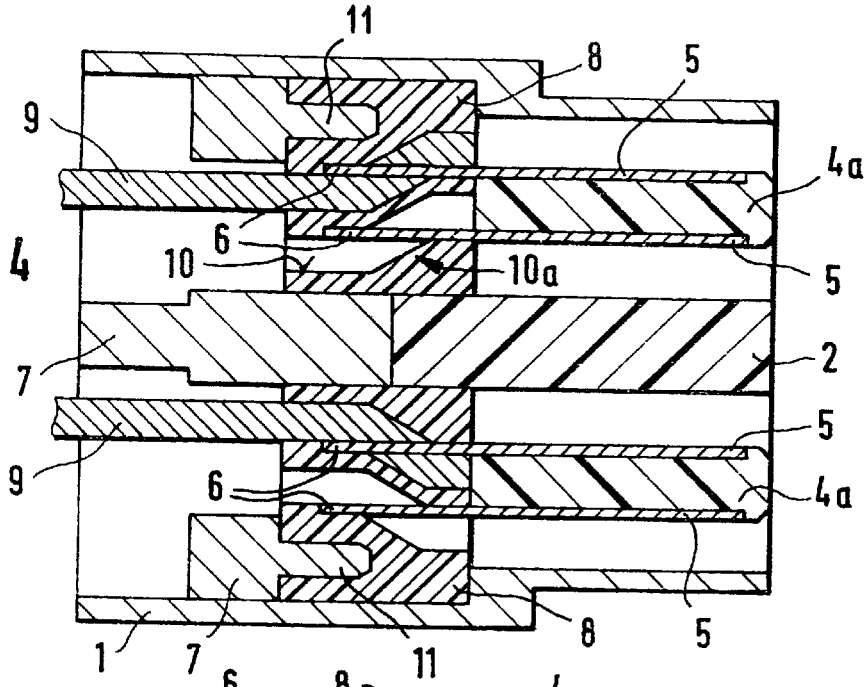
FIG. 4 is a schematic view of a lengthwise section through the connector housing in FIG. 2 taken along section line IV—IV.
Figure 5:
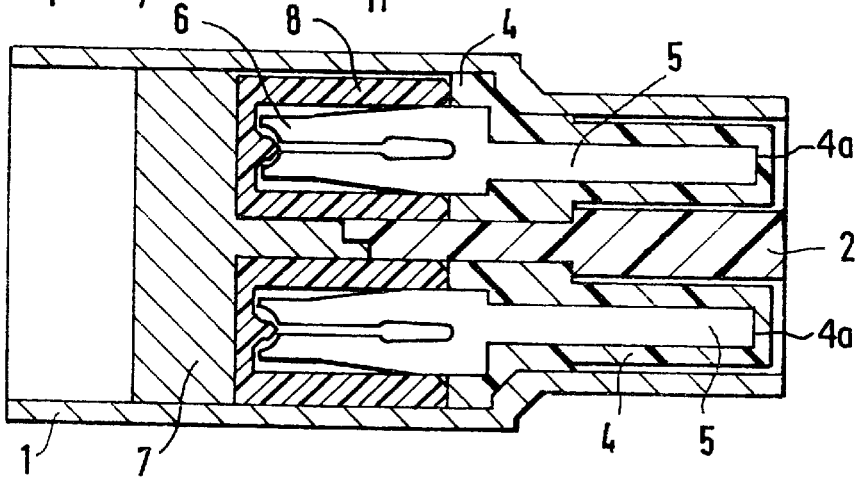
FIG. 5 is a lengthwise section through the connector housing of FIG. 2 taken along section line V—V.

Contacts 5 are designed as insulation-piercing connecting devices and change into forked insulation-piercing clips 6 in their areas that face away from plug pins 4*a,* and these clips 6, as shown in FIG. 3, project outward from the insulating bodies 4 on the connecting side. These insulation-piercing clips 6, inside housing 1, point toward a contact element 7 made of a conducting material which in the embodiment forms a cross on which four pushable insert elements 8 made of insulating material can be mounted, into which the wire ends of the shielded connecting cable, not shown, can be introduced. This is accomplished, as shown in FIG. 4, by the fact that the wire ends 9 that have not been stripped of their insulation I are introduced into the guide openings 10 of the insert elements adjacent the insulating bodies 4 in the later plugging direction and, because the guide openings 10 have a section 10*a* that extends diagonally to the plugging direction, extend there for a portion of their length at an angle to the later plugging and assembly direction.

Figure 6:
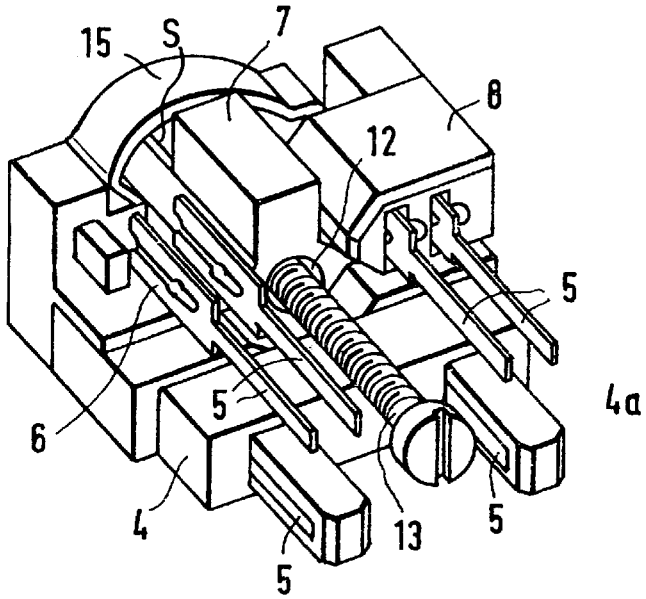
FIG. 6 is a schematic perspective view of the inside parts of the connector housing in FIG. 2.

Insert elements 8, as can be seen from FIG. 6, are pushed onto pins 11 of the cruciform contact element 7 and thus are held in place.

The cruciform contact element 7 has at its center an opening 12 with a thread 12T into which a screw 13 can be introduced that is inserted through a corresponding opening 14 in the partitions 2 of housing 1 up to the cruciform contact element 7.

When this screw 13 is tightened, the cruciform contact element 7 together with the clips 8 on it is moved in the direction of housing 1 with its partitions 2 and the insulation-piercing clips 6 of contacts 5 enter the openings 10 of insert elements 8 and contact the wire ends 9.

A small mandrel is mounted centrally on contact element 7 on the side facing away from screw 13, said mandrel not being shown. The cable to be connected can be fixed in place on the mandrel. The shielding S of the cable is brought into contact with contact element 7 at 7A by a crimping ring 15. Contact element 7 itself has its cruciform walls abutting the inside wall of the housing so that as a result, and with the aid of screw 13, the shielding S of the cable is formed with respect to the housing and, as described previously, on the individual chambers 3 of housing 1 as well. The connecting part of the cable, as indicated in FIG. 1, can be covered by a protective cap 16 which can be guided over the crimping ring 15 and over the housing 1.

Therefore a connector with a very simple design is created by the invention, and can be provided with sufficient shielding to permit its use for analog and digital data transmission even at frequencies up to 600 MHz and above 600 MHz. The connection of the wire ends is achieved in simple fashion. Troublesome stripping of the insulation from the cable ends and introduction into separate contact sleeves are superfluous.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An electrical cable connector for connecting a shielded cable with plural free wire ends, said connector comprising:

a shielded housing made of electrically conducting material and including separating ribs to form a plurality of separate shielded housing chambers, insulation piercing connecting devices located in each housing chamber, a contact element comprising electrically conducting material which is insertable into the housing in contact with the housing walls, pushable insert elements in each housing chamber made of insulating material and carried by the contact element and including guides for holding wire end sections of the shielded cable to be connected, insulating bodies in each housing chamber for holding respective ends of respective connecting devices which face away from the shielded cable to be connected, and a screw connecting the housing and contact element and extending in a plugging direction of the connector, said screw operating upon tightening to move the contact elements with respect to the housing to thereby force the respective connecting devices to pierce insulation in the respective cable wire end sections and form an electrical connection between the respective cable wire end sections and the respective connecting devices.

2. An electrical cable connector according to claim 1, wherein the screw is accessible from an open connecting side of the housing and runs in an opening centrally in the separating ribs of the housing.

3. An electrical cable connector according to claim 1, wherein the contact element is designed as a cross with a central thread.

4. An electrical cable connector according to claim 2, wherein the contact element is designed as a cross with a central thread.

5. An electrical cable connector according to claim 1, comprising a crimping ring for holding the shielded cable on the contact element.

6. An electrical cable connector according to claim 5, comprising an insulated protective cap which can be pushed over the crimping ring and housing.

* * * * *